United States Patent [19]

Koura et al.

[11] Patent Number: 5,018,303

[45] Date of Patent: May 28, 1991

[54] AUTOMATIC DOOR OPERATING SYSTEM

[75] Inventors: Soushichi Koura; Jun Yamagishi, both of Yokohama, Japan

[73] Assignee: Ohi Seisakusho Co., Ltd., Yokohama, Japan

[21] Appl. No.: 526,653

[22] Filed: May 22, 1990

[30] Foreign Application Priority Data

May 22, 1989 [JP] Japan ..... 1-58087
May 24, 1989 [JP] Japan ..... 1-59120

[51] Int. Cl.[5] ..... E05F 15/00

[52] U.S. Cl. ..... 49/280; 49/357; 49/360

[58] Field of Search ..... 49/280, 213, 357, 360; 296/155

[56] References Cited

U.S. PATENT DOCUMENTS 4,698,938 10/1987 Huber ..... 49/138
4,862,640 9/1989 Boyko et al. ..... 49/280 X

FOREIGN PATENT DOCUMENTS 58-178778 10/1983 Japan .
1-164647 6/1989 Japan .

*Primary Examiner*—Philip C. Kannan

*Attorney, Agent, or Firm*—Foley & Lardner

[57] ABSTRACT

Disclosed herein is an automatic door operating system for use in a motor vehicle having a vehicle body and a movable door. The system comprises a first device for allowing the door to assume an open position, a half-latch position and a full-close latched-position, the open position being a position wherein the door opens a door opening defined by the vehicle body, the half-latch position being a position wherein the door is halfly latched to the vehicle body while almost closing the door opening and the full-close latched position being a position wherein the door is fully latched to the vehicle body while fully closing the door opening; an electric door moving device for moving the door between the open position and the full-close latched position when energized; and electric door closing device for shifting the door from the half-latch position to the full-close latched position when energized; a second device controlling the door closing operation of the electric door moving device; a third device for feeding the electric door closing device with electric power; and a fourth device for allowing the second and third devices to cooperate with each other to eliminate a possible trouble which may occur when the door comes to a position adjacent to the half-position.

16 Claims, 3 Drawing Sheets

AUTOMATIC DOOR OPERATING SYSTEM

BACKGROUND OF THE INVENTION

1. Field of the Invention

The present relates, in general, to an automatic door operating system, and more particularly to an automatic slide door operating system for use in a motor vehicle. More specifically, the present invention is concerned with an automatic slide door operating system in which the opening and closing movement of the door is carried out by a power device, upon manipulation of a control switch.

2. Description of the Prior Art

Hitherto, in motor vehicles, particularly, in so-called "one-box" type motor vehicles having slide doors, various power systems have been proposed and put into practical use for opening and closing the door with an aid of a power device. Some of them are described in Japanese Patent First Provisional Publications Nos. 58-178778 and 1-164647.

The systems disclosed by these publications are of a type which generally comprises a door moving device which is mounted to a vehicle body for moving the slide door in both directions to open and close a door opening of the vehicle, a door closing device which is mounted in the door for enforcedly shifting the door from a half-latch position to a full-close latched position relative to the door opening, and a latch cancelling device for canceling the latched condition of the door just before starting of the door opening operation of the door moving device.

Both the door moving device and the door closing device use electric motors as a prime mover.

The reason for the door closing device in addition to the door moving device is that the shifting of the door from the half-latch position to the full-close latched position needs a great force because of a considerable resistance offered by an elastomeric door seal fixed to the door. In fact, the door shifting from the half-latch position to the full-close latched position is not achieved by only the door moving device.

That is, when the door is slid to the half-latch position by the door moving device, the door closing device starts to operate for shifting the door from the half-latch position to the full-close latched position in cooperation with the door moving device.

For allowing the door closing device to produce a higher torque needed for the door shifting from the half-latch position to the full-close latched position, the door closing device is equipped with a speed reduction gear by which the output speed of the associated electric motor is very much lowered.

However, these conventional door operating systems have several drawbacks caused by the provision of two power devices, i.e., the door moving device and the door closing device.

One of the drawbacks is that, under the shifting of the door from the half-latch position to the full-close latched position, the door shifting speed offered by the door closing device is very much lower than that provided by the door moving device because of the large speed reduction made by the speed reduction gear of the door closing device. This phenomenon brings about an overload of both power devices thereby shortening their lives.

SUMMARY OF THE INVENTION

It is therefore an object of the present invention to provide an automatic door operating system which is free of the above-mentioned drawback.

Another object of the present invention is to provide an automatic door operating system which is equipped with a fail-safe means for dealing with the possibly undesirable matter in which the door is forced to stop during its closing movement due to, for example, a foreign object accidentally caught between the door and the vehicle body.

According to the present invention, there is provided an automatic door operating system for use in a motor vehicle having a vehicle body and a movable door. The system comprises a first means for allowing the door to assume an open position, a half-latch position and a full-close latched position, the open position being a position wherein the door opens a door opening defined by the vehicle body, the half-latch position being a position wherein the door is half latched to the vehicle body while almost closing the door opening and the full-close latched position being a position wherein the door is fully latched to the vehicle body while fully closing the door opening; an electric door moving device for moving the door between the open position and the full-close latched position when energized; an electric door closing device for shifting the door from the half-latch position to the full-close latched position when energized; and second means for controlling the door closing operation of said electric door moving device; third means for feeding said electric door closing device with electric power; and fourth means for allowing said second and third means to cooperate with each other to eliminate possible trouble when said door comes to a position adjacent to said half-latch position.

DETAILED DESCRIPTION OF THE INVENTION

Figure 1:
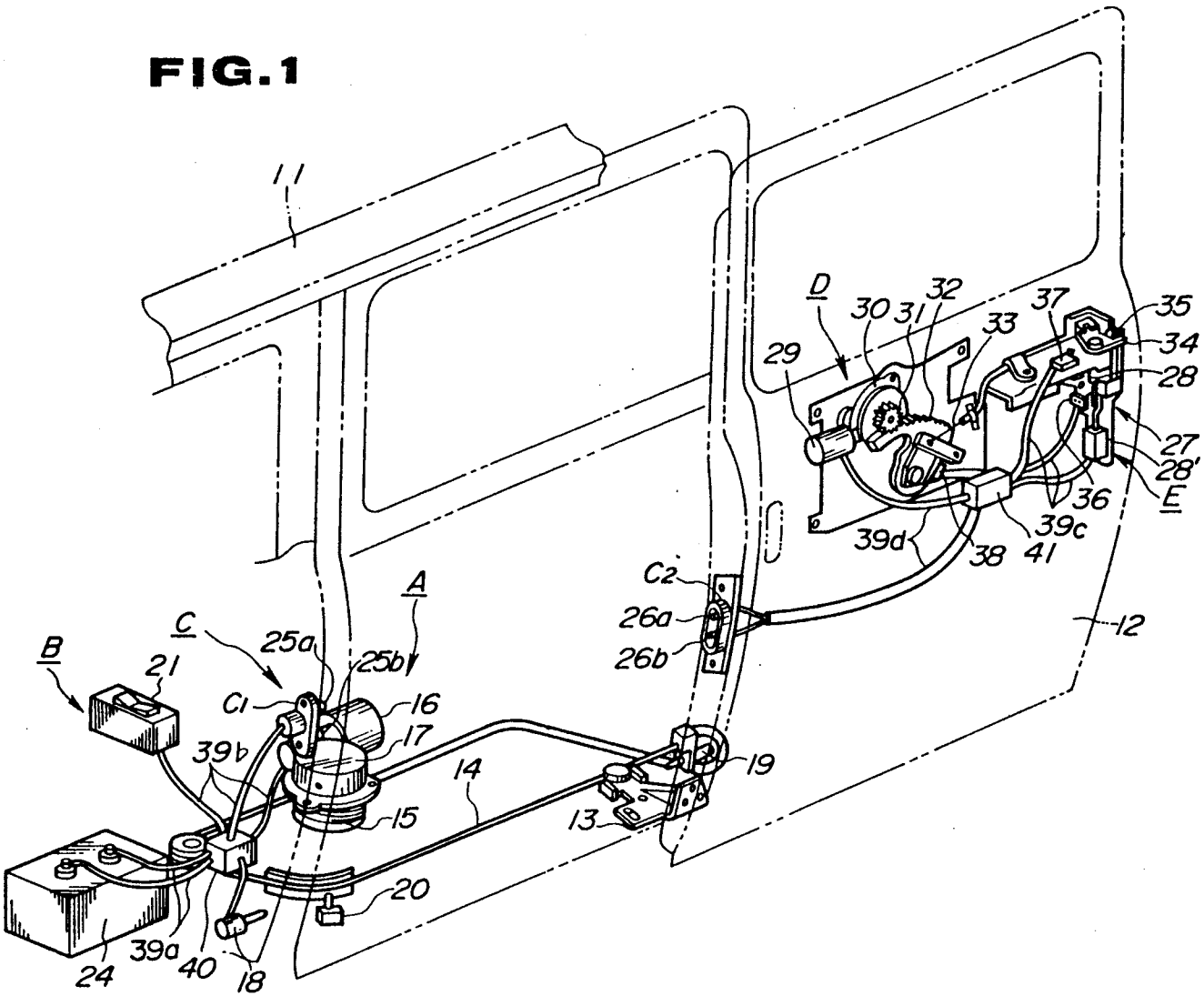
FIG. 1 is a perspective view of a power slide door to which the present invention is applied.

Referring to FIG. 1, there is shown a power slide door of a motor vehicle, to which the present invention is applied.

In the drawing, denoted by numeral 11 is a vehicle body, and denoted by numeral 12 is a slide door. Although not shown in the drawing, a known door guide structure is employed by which a guide for the door 12 is defined. That is, under door opening operation, the door 12 in the full-close position is shifted laterally outward and then moved rearward toward the full-open position. The movement of the door 12 from the full-open position to the full-close position is carried out by doing the reverse.

As shown, at a lower portion of the vehicle body 11, there is arranged a door moving device "A" by which the door 12 is driven between the full-close and full-open positions travelling along the guide way defined by the door guide structure.

The door moving device "A" is described in U.S. Pat. No. 4,640,050. The device "A" will be briefly described with reference to FIG. 1.

A bracket 13 is secured to a lower front portion of the door 12. The bracket 13 has a drive cable 14 fixed thereto, which cable has a part extending along the guide way for the door 12. The cable 14 has both end portions wound around a drive drum 15. The drum 15 is driven by a reversible electric motor 16 through a speed reduction gear 17. Thus, upon energization of the motor 16, the drive drum 15 is rotated in one or the other direction to move the slide door 12 in opening or closing direction along the guide way for the door 12.

The door moving device "A" is controlled by a door-close detecting switch 18 and a door-open detecting switch 19. The door-close detecting switch 18 is of a normally closed type, which is mounted on the vehicle body 11 and turned OFF when the door 12, during closing movement, passes by the after-mentioned half-latch available position. For this operation, the switch 18 has an antenna pin which is contactable with a front end of the door 12. The door-open detecting switch 19 is of a normally open type, which is mounted on the vehicle body 11 and turned ON when the door 12 comes to the full-open position. For this operation, the switch 19 has an antenna pin which is contactable with a rear end of the bracket 13 of the door 12.

The vehicle body 11 has a so-called "feeding start position detecting switch 20" mounted thereto. The switch 20 is of a normally open type and so constructed and arranged as to close for a moment only when the front end of the slide door 12, during closing movement thereof, passes by a so-called "feeding start position" which is near a so-called "half-latch available position" where the door 12 can assume an after-mentioned half-latch condition. It is to be noted that when the front end of the door 12 assumes the feeding start position, there is defined a small clearance between the front end of the door 12 and a front end of the door opening, which clearance is so sized as not to permit insertion of an operator's hand therethrough. More specifically, the clearance is somewhat greater than a clearance which is defined when the door 12 assumes the half-latch available position.

Designated by reference "B" is a controlling device which is mounted on the vehicle body 11 at a position near the driver's seat. The controlling device "B" comprises a seesaw type button switch 21.

Figure 2:
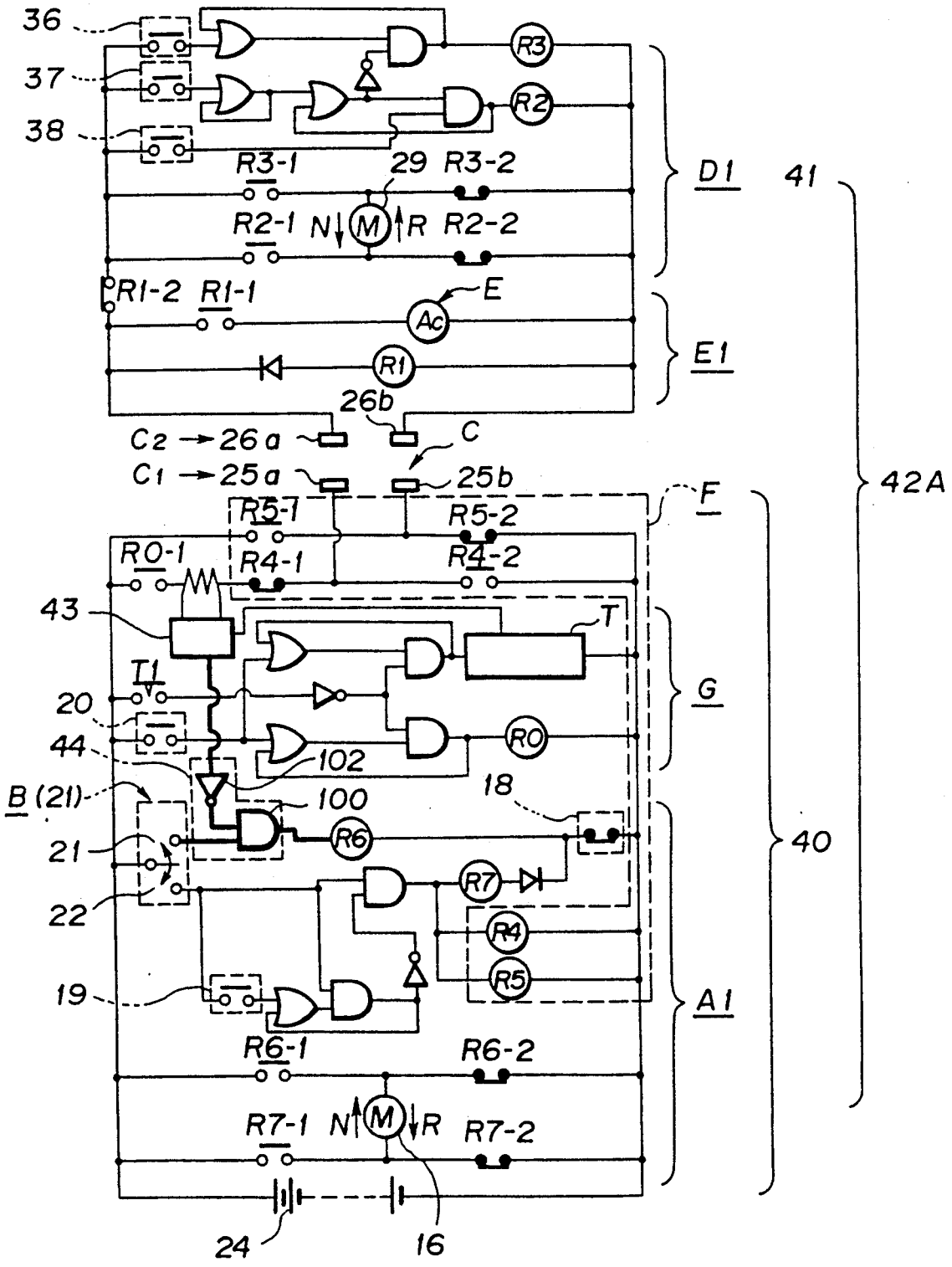
FIG. 2 is a control circuit employed in a first embodiment of the present invention.

As will be seen from FIG. 2, the button switch 21 comprises one movable contact and two stationary contacts. The movable contact and one stationary contact constitute a so-called "door opening control switch" 22 and the movable contact and the other stationary contact constitute a so-called "door closing control switch" 23. That is, when the button is pivoted in one direction, the switch 22 is closed, while, when the button is pivoted in the other direction, the other switch 23 is closed.

Referring back to FIG. 1, designated by numeral 24 is a battery which serves as an electric power source.

Designated by reference "C" is an electric connector which comprises mutually engagable first and second connector parts $C_1$ and $C_2$ each including two axially movable contact pins 25*a* and 25*b* (or, 26*a* and 26*b*). Each contact pin is biased to project by a spring associated therewith.

The first connector part $C_1$ is mounted on a front end of the door opening having the contact pins 25*a* and 25*b* directed rearward and the second connector part $C_2$ is mounted on a front end of the slide door 12 having the contact pins 26*a* and 26*b* directed forward.

The first and second connector parts $C_1$ and $C_2$ are engaged to establish an electric connection therebetween when the door 12 closes. More specifically, when the slide door 12 assumes a position between the feeding start position and the full-close position, the contact pins 25*a* and 25*b* of the first connector part $C_1$ and the corresponding contact pins 26*a* and 26*b* of the second connector parts $C_2$ are mated with each other. Thus, under this condition, electric power feeding from the battery 24 on the vehicle body 11 to after-mentioned electric devices in the slide door 12 is available.

The contact pins 25*a* and 25*b* of the first connector part $C_1$, the motor 16, the door-close detecting switch 18, the door-open detecting switch 19, the control device "B", the feeding start position detecting switch 20 and the battery 24 are connected through suitable lead wires 39*a* and 39*b* to a body-mounted control unit 40.

Within the slide door 12, there is mounted a door closing device "D" which functions to shift the door 12 from the half-latch position to the full-close position.

That is, as will be described in detail hereinafter, when the door 12 comes to the half-latch available position, a latch pawl (not shown) of a door lock device 27 becomes incompletely or half engaged with a striker (not shown) secured to the vehicle body 11, and thereafter, due to the work of the door closing device "D", the latch pawl is forced to turn to achieve a complete engagement with the striker enforcedly shifting the door 12 to the full-close latched position.

Within the slide door 12, there is further mounted a door unlatching device "E" which functions to cancel the latched condition of the slide door 12 in the full-close position. For achieving this cancelling operation, the door unlatching device "E" has an open lever 28 incorporated with the door lock device 27 and a solenoid-spring combination type actuator 28' incorporated with the open lever 28. That is, upon energization of the actuator 28', the open lever 28 is pulled in a direction to cancel the latched condition of the door lock device 27. Thus, the slide door 12 becomes unlatched and thus thereafter, the opening movement of the door 12 is available.

The door closing device "D" is disclosed in U.S. patent application Ser. No. 07/287,277 filed Dec. 21, 1988 in the name of Jun YAMAGISHI et al. In the following, the device "D" will be briefly described with reference to FIG. 1.

The device "D" comprises an electric motor 29, a speed reduction gear 30 driven by the motor 29, a pinion 31 driven by an output shaft of the reduction gear 30 and a sector gear 32 meshed with and thus driven by the pinion 31.

When the motor 29 is energized to run in a normal direction, the sector gear 32 pivots in a counterclockwise direction in FIG. 1 thereby pulling a cable 33 which leads to a close lever 34. With this movement, the close lever 34 is pivoted in one direction to move the latch pawl of the door lock device 27 to the full-latch position. With this, the slide door 12 is forced to shift from the half-latch position to the full-close latched position. Designated by numeral 35 is an arm possessed by the latch pawl, against which the close lever 34 actually abuts for the movement of the latch pawl.

When, thereafter, the motor 29 is energized to run in the reverse direction, the sector gear 32 and thus the close lever 34 are moved in the other direction, and finally, they are returned to their original positions. The close lever 34 stops at a position remote from the arm 35 of the latch pawl. It is to be noted that under this condition, the full-close latched condition of the door 12 is kept unchanged.

Designated by numeral 36 is a half-latch detecting switch mounted to the door lock device 27, which functions to detect the arrival of the door 12 to the half-latch available position. That is, the switch 36 is turned ON when, upon abutment of the striker against the latch pawl due to the arrival of the door 12 to the half-latch available position, the open lever 28 is slightly turned in the lock cancelling direction.

Designated by numeral 37 is a full-latch detecting switch which is mounted to the door lock device 27. The switch 37 functions to detect the full-latch condition of the door lock device 27. That is, the switch 37 is turned ON when the close lever 34 abuts on the switch 37 turning the latch pawl to the full-latch position.

Designated by numeral 38 is a so-called "return recognition switch" which detects whether the sector gear 32 has returned to a rest position or not. The switch 38 is kept OFF when the sector gear 32 is in the rest position as shown in FIG. 1, but turned ON when the sector gear 32 is pivoted away from the rest position.

The motor 29, the half-latch detecting switch 36, the full-latch detecting switch 37, the return recognition switch 38 and the actuator 28' are connected through suitable lead wires **39*c* to a door-mounted control unit 41. The contact pins 26*a* and 26*b* of the second connector part $C_2$ are connected to the control unit 41 through lead wires 39*d***, as shown.

FIG. 2 shows a control circuit 42A employed in the first embodiment of the present invention.

The control circuit 42A comprises generally the body-mounted control unit 40 and the door-mounted control unit 41.

The body-mounted control unit 40 comprises a control device "A1" which controls the door moving device "A", a positive/negative switching device "F" which switches the polarity of electric power fed to the contact pins **25*a* and 25*b* of the first connector part $C_1$ in response to operation of the controlling device "B", and a time-counting device "G" which controls, by using a timer "T", the time for which electric power feeding is carried out during closing movement of the door 12**.

The door-mounted control unit 41 comprises a control device "D1" which controls the door closing device "D" and a control device "E1" which controls the door unlatching device "E".

Denoted by references R0, R1, R2, . . . R7 are relays, R0-1, R1-1, R2-1, . . . R7-2 (FIG. 2) are contacts of the relays. T1 is a timer contact of the timer T, and denoted by numeral 43 is a current detector which resets the timer T when detecting that a predetermined current sufficient for operating the motor 29 flows through a series circuit which includes the contact R0-1 and the contact R4-2. AND gates, OR gates, inverters and diodes are arranged in respective circuits in the illustrated manner.

In the first embodiment, a stop control means 44 is employed for eliminating the drawback encountered in the above-mentioned conventional automatic slide door operating system.

That is, as is illustrated by a thicker line in FIG. 2, in the stop control means 44, there is employed an AND gate 100, which has one input terminal connected to the door closing control switch 23 of the controlling device "B" and the other input terminal connected through an inverter 102 to the current detector 43. An output terminal of the AND gate 100 is connected to the relay R6.

When, upon operation of the door closing device "D", the current detector 43 detects that a predetermined current flows through the series circuit, the stop control means 44 stops the electric power feeding to the electric motor 16 of the door moving device "A".

In the following, operation of the first embodiment will be described with reference to FIGS. 1 and 2.

For ease of understanding, the description will be commenced with respect to the full-close latched condition of the slide door 12. Under this condition, the first and second connector parts $C_1$ and $C_2$ of the electric connector C are coupled, the controlling device B (viz., the button switch 21) assumes a neutral position, the door-close detecting switch 18 is opened, the full-latch detecting switch 37 is closed, the normally open switches are all opened, the normally close switches are all closed and the relays are all deenergized.

When the door opening control switch 21 of the controlling device B is closed by, for example, a driver in the vehicle, the relays R4 and R5 are simultaneously energized causing the normally open contacts R4-2 and R5-1 to close and the normally closed contacts R4-1 and R5-2 to open. Upon this happening, electric power feeding to the electric connector C is available having the contact pins **25*a* and 25*b*** charged negatively and positively, respectively.

Thus, a circuit including the contact pin **26*b*, the relay R1, the diode and the contact pin 26*a* is established and thus, the relay R1** is energized.

Upon this, the contact R1-1 of the relay R1 is closed energizing the actuator 28' of the door unlatching device E, and at the same time, the contact R1-2 of the relay R1 is opened deenergizing the door closing device control device D1.

Upon operation of the actuator 28', the open lever 28 of the door lock device 27 is turned in a direction to cancel the latched condition of the door 12, so that the door 12 is shifted to the half-latch available position due to the biasing force produced by the door seal.

Upon this, the door-close detecting switch 18 is closed energizing the relay R7 and thus causing the contacts R7-1 and R7-2 to close and open respectively. Thus, a circuit including the contact R7-1, the motor 16 and the contact R6-1 is established and thus the motor 16 is energized to run in a normal direction. With this, the door 12 starts to move in a direction to open the door opening.

When the door 12 passes by the feeding start position, the second connector part $C_2$ of the electric connector C is uncoupled from the first connector part $C_1$ and thus current feeding to the door-mounted electric devices is ceased. Upon this, the relay R1 is deenergized and the actuator 28' is deenergized, and thus, the open lever 28 of the door unlatching device E is returned to its original position by the force of the return spring of the device E.

Due to continuous work of the door moving device A, the opening movement of the door 12 is continued.

When the door 12 comes to the full-open position, the door-open detecting switch 19 is closed. With this, the relays R7, R4 and R5 are all deenergized at the same time, and their contacts returned to their original positions. Thus, electric feeding to the motor 16 is ceased, and electric power flow toward the first connector part $C_1$ is ceased.

When, with the door 12 assuming the full-open or half-open position, the door closing control switch 23 of the controlling device B is closed by, for example, a driver, the relay R6 is energized. It is now to be noted that under this condition, the current detector 43 is inoperative, so that one of the input terminals of the AND gate 100 of the stop control means 44 is fed with "1" signal which has been inverted by the inverter 102.

Upon this, the contact R6-1 is closed and the contact R6-2 is opened and a circuit including the contact R6-1, the motor 16 and the contact R7-2 is established. Thus, the motor 16 is energized to run in a reversed direction.

With this, the door 12 is moved in a direction to close the door opening.

When the door 12 comes to the feeding start position, the second connector part $C_2$ and the first connector part $C_1$ of the electric connector C become coupled and the feeding start position detecting switch 20 is closed for a moment.

With this, the relay R0 and the timer T are energized and thus they are brought to the respective self-holding conditions.

When, due to energization of the relay R0, the contact R0-1 is closed, the contact pin 25*a* of the first connector part $C_1$ is connected through the contacts R0-1 and R4-1 to the positive terminal of the battery 24 (viz., electric power source), and the other contact pin 25*b* is connected through the contact R5-2 to the negative terminal of the battery 24. Under this condition, electric power is transmitted to the electric connector C having the contact pins 25*a* and 25*b* charged positive and negative respectively, unlike the above-mentioned case wherein the door 12 is being opened.

The timer T is so constructed that when a predetermined time (for example, ten seconds) passes after charging of the same, the timer contact T1 is closed.

When, due to, for example, presence of a foreign thing accidentally caught between the door 12 and the vehicle body 11, the door 12 is forced to stop at a position between the feeding start position and the half-latch available position and the predetermined time passes, the timer contact T1 is closed and thus the relay R0 is deenergized. Thus, electric power feeding toward the electric connector C ceases and electric power feeding for the timer T also ceases. These prevent waste of electric power.

When, within the predetermined time, the motor 29 of the door closing device D is operated in an aftermentioned manner and thus a certain degree of current flows through the series circuit which includes the contact R0-1 and the contact R4-2 the current detector 43 detects the current and thus resets the timer T. Thus, thereafter, the timer T starts the time counting again.

Accordingly, even when the motor 29 starts its operation just before the time when the predetermined time elapses, instant deenergization of the relay R0 does not occur and thus instant stop of power feeding to the motor 29 does not occur. That is, from the time when the timer T is reset, electric power feeding to the door-mounted electric devices is continued for a time sufficient for operating the motor 29 to accomplish the movement of the slide door 12 from the half-latch position to the full-close latched position.

Even when the operation of the motor 29 continues for a considerably longer time because, for example, a foreign object is caught between the door 12 and the vehicle body 11, the operation of the motor 29 stops at the time when the predetermined time set by the timer T elapses. Thus, safety of the motor 29 is assured. That is, upon expiration of the predetermined time, the timer contact T1 of the timer T is closed and, thus, the relay R0 is deenergized causing deenergization of the motor 29.

When, after starting of electric power feeding to the door-mounted electric devices, the door 12 is moved to the half-latch available position due to the continuous work of the door moving device A, the half-latch detecting switch 36 of the door closing device control device D1 is momently closed. Thus, the relay R3 is energized and kept in the self-holding condition.

With this, the contact R3-1 is closed, the contact R3-2 is opened, and the circuit including the contact R3-1, the motor 29 and the contact R2-2 is established, so that the motor 29 is energized to run in a normal direction.

Upon this, the current detector 43 detects the current fed to the motor 29. Thus, as has been described hereinabove, the timer T is reset, and at the same time, a "0" signal which has been inverted by the inverter 102 is fed to one input terminal of the AND gate 100 of the stop control means 44. With this, the relay R6 is deenergized and the reversed rotation of the motor 16 is ceased. Accordingly, the door closing operation of the door moving device A is ceased upon starting of operation of the door closing device D.

When, due to normal rotation of the motor 29, the sector gear 32 is pivoted in a counterclockwise direction in FIG. 1, the cable 33 is pulled leftward turning the close lever 34. With this, the latch pawl of the door lock device 27 is forced to achieve complete engagement with the striker enforcedly shifting the door 12 to the full-close latched position. It is to be noted that this shifting of the door 12 is achieved by only the door closing device D.

When the sector gear 32 is pivoted in a counterclockwise direction in FIG. 1 from the rest position, the return recognition switch 38 is closed or turned ON. However, this closing of the switch 38 has no effect on the relays.

When, thereafter, the latch pawl of the door lock device 27 is turned to the full-latch position, the full-latch detecting switch 37 is closed causing deenergization of the relay R3 and energization of the relay R2.

With this, the contacts R3-1 and R2-2 are opened and the contacts R2-1 and R3-2 are closed, so that the circuit including the contact R2-1, the motor 29 and the contact R3-2 is established thereby energizing the motor 29 to run in a reverse direction.

With this, the sector gear 32 is pivoted in a clockwise direction to the rest position as shown in FIG. 1.

Upon this, the return recognition switch 38 is opened, causing deenergization of the relay R2. Thus, the contact R2-1 is opened and the contact R3-2 is closed, so that the motor 29 is deenergized, and thus the motor 29 stops.

When, thereafter, the predetermined time set by the timer T elapses, the relay R0 is deenergized causing the contact R0-1 to open. With this, electric power feeding to the electric connector C stops.

When, as has been described hereinabove, the latch pawl of the door lock device 27 is turned to the full-latch position, the door 12 is shifted to the full-close latched position. Upon this, the door-close detecting switch 18 is opened. Thus, the contact R6-1 is opened and the other contact R6-2 is closed, so that the motor 16 of the door moving device A is deenergized. Accordingly, the door 12 can keep the full-close latched condition having the electric devices kept deenergized.

As will be understood from the foregoing description, in the first embodiment of the present invention, the shifting of the slide door 12 from the half-latch position to the full-close latched position is achieved by only the door closing device D.

That is, when, due to the work of the door moving device A, the door 12 is moved to the half-latch available position, the door closing device D starts to operate and at the same time the door moving device A stops to operate.

Accordingly, the undesired phenomenon possessed by the above-mentioned conventional door operating system is eliminated.

Figure 3:
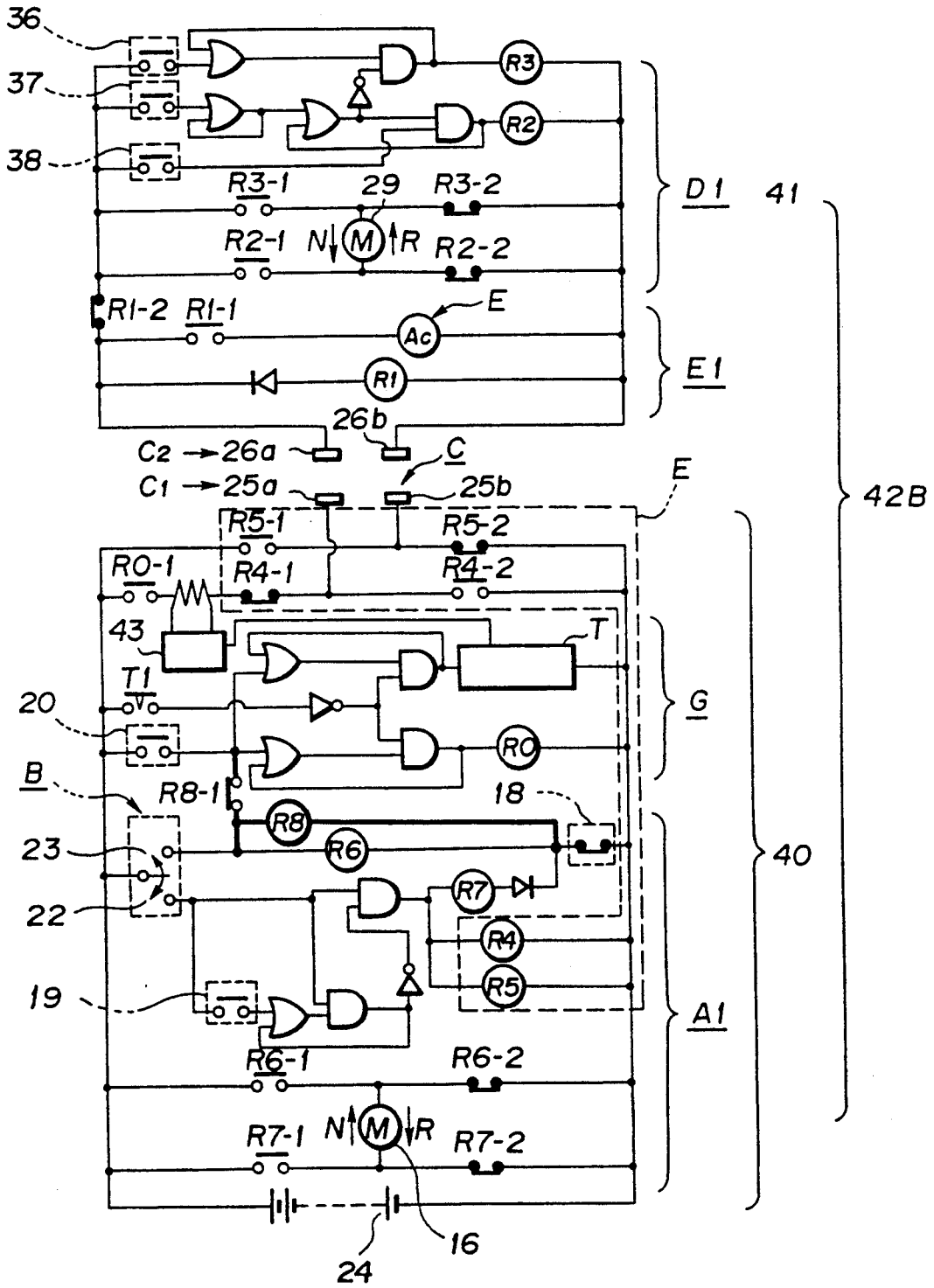
FIG. 3 is a control circuit employed in a second embodiment of the present invention.

Referring to FIG. 3, there is shown an electric circuit 42B which is employed in a second embodiment of the present invention.

As will become apparent as the description proceeds, the second embodiment is somewhat improved in function as compared with the first embodiment.

Since the electric circuit 42B is very similar to that of the afore-mentioned first embodiment, the following explanation will be directed to only parts and constructions which are different from those of the first embodiment.

A relay R8 is additionally employed in the second embodiment, which has a normally closed contact R8-1. The contact R8-1 is arranged in parallel with the feeding start position detecting switch 20. The relay R8 is deenergized when the door closing control switch 23 of the controlling device B is closed and the door-close detecting switch 18 is opened due to placing of the door 12 at a position between the full-close latched position and the half-latch position. Due to the deenergization of the relay R8, the contact R8-1 of the relay R8 is closed. Thus, only at such time, the contact R8-1 provides a condition which is established when the feeding start position detecting switch 20 is closed.

In the following, operation of the second embodiment will be described with reference to FIGS. 1 and 3.

For ease of understanding, the description will be commenced with respect to the full-close latched condition of the slide door 12. Under this condition, the first and second connector parts $C_1$ and $C_2$ of the electric connector C are coupled, the controlling device B assumes a neutral position, the door-close detecting switch 18 is opened, the full-latch detecting switch 37 is closed, the normally open switches are all opened, the normally closed switches are all closed and the relays are all deenergized.

When, now, the door opening control switch 22 of the controlling device B is closed by, for example, a driver in the vehicle, the relays R4 and R5 are simultaneously energized causing the normally open contacts R4-2 and R5-1 to close and the normally close contacts R4-1 and R5-2 to open. Upon this, electric power feeding to the electric connector C is available having the contact pins **25*a* and 25*b*** charged negatively and positively, respectively.

Thus, a circuit including the contact pin **26*b*, the relay R1, the diode and the contact pin 26*a* is established and thus, the relay R1** is energized.

Upon this, the contact R1-1 of the relay R1 is closed energizing the actuator 28' of the door unlatching device E, and at the same time, the contact R1-2 of the relay R1 is opened deenergizing the door closing device control device D1.

Upon operation of the actuator 28', the open lever 28 of the door lock device 27 is turned in a direction to cancel the latched condition of the door 12, so that the door 12 is shifted to the half-latch available position due to the biasing force produced by the door seal.

Upon this, the door-close detecting switch 18 is closed energizing the relay R7 and thus causing the contacts R7-1 and R7-2 to close and open respectively. Thus a circuit including the contact R7-1 the motor 16 and the contact R6-1 is established and thus the motor 16 is energized to run in a normal direction. With this, the door 12 starts to move in a direction to open the door opening.

When the door 12 passes by the feeding start position, the second connector part $C_2$ of the electric connector C is uncoupled from the first connector part $C_1$ and thus current feeding to the door-mounted electric devices ceases. Upon this, the relay R1 is deenergized and the actuator 28' is deenergized, and thus, the open lever 28 of the door unlatching device E is returned to its original position by the force of a return spring of the device E.

Due to continuous work of the door moving device A, the opening movement of the door 12 is continued.

When the door 12 comes to the full-open position, the door-open detecting switch 19 is closed. With this, the relays R7, R4 and R5 are all deenergized at the same time, and the contacts of them are returned to their original positions. Thus, electric feeding to the motor 16 is ceased, and electric power flow toward the first connector part $C_1$ is ceased.

When, with the door 12 assuming the full-open or the half-open position, the door closing control switch 23 of the controlling device B is closed by, for example, a driver, the relay R6 and the relay R8 are simultaneously energized because of close-condition of the door-close detecting switch 18.

Due to energization of the relay R8, the contact R8-1 of the relay R8 is opened and the electric feeding to the timer control device G is ceased.

Due to energization of the relay R6, the contact R6-1 is closed and the contact R6-2 is opened and a circuit including the contact R6-1, the motor 16 and the contact R7-2 is established. Thus, the motor 16 is energized to run in a reverse direction.

With this, the door 12 is moved in a direction to close the door opening.

When the door 12 comes to the feeding start position, the second connector part $C_2$ and the first connector part $C_1$ of the electric connector C become coupled and the feeding start position detecting switch 20 is closed for a moment.

With this, the relay R0 and the timer T are energized and thus they are brought to the respective self-holding conditions.

When, due to energization of the relay R0, the contact R0-1 is closed, the contact pin **25*a* of the first connector part $C_1$ is connected through the contacts R0-1 and R4-1 to the positive terminal of the battery 24 (viz., electric power source), and the other contact pin 25*b* is connected through the contact R5-2 to the negative terminal of the battery 24. Under this condition, electric power is transmitted to the electric connector C having the contact pins 25*a* and 25*b* charged positively and negatively, respectively, unlike the above-mentioned case wherein the door 12** is being opened.

The timer T is so constructed that when a predetermined time (for example, ten seconds) passes after charging of the same, the timer contact T1 is closed.

When, due to, for example, a foreign object accidentally caught between the door 12 and the vehicle body 11, the door 12 is forced to stop at a position between the feeding start position and the half-latch available position and the predetermined time passes, the timer contact T1 is closed and thus the relay R0 is deenergized. Thus, electric power feeding toward the electric connector C ceases and electric power feeding to the timer T also ceases. These prevent waste of electric power.

When, within the predetermined time, the motor 29 of the door closing device D is operated in an aftermentioned manner and thus a certain degree of current flows through the series circuit which includes the contact R0-1 and the contact R4-2, the current detector 43 detects the current and thus resets the timer T. Thus, thereafter, the timer T starts the time counting again.

Accordingly, even when the motor 29 starts its operation just before the time when the predetermined time elapses, instant deenergization of the relay R0 does not occur and thus instant stop of power feeding to the motor 29 does not occur. That is, from the time when the timer T is reset, electric power feeding to the door-mounted electric devices is continued for a time sufficient for operating the motor 29 to accomplish the movement of the slide door 12 from the half-latch position to the full-close latched position.

Even when the operation of the motor 29 is continued for a considerably longer time because, for example, a foreign object is caught between the door 12 and the vehicle body 11, the operation of the motor 29 stops at the time when the predetermined time set by the timer T elapses. Thus, safety of the motor 29 is assured. That is, upon expiration of the predetermined time, the timer contact T1 of the timer T is closed and thus the relay R0 is deenergized causing deenergization of the motor 29.

When, after starting of the electric power feeding to the door-mounted electric devices, the door 12 is moved to the half-latch available position by the door moving device A, the door-close detecting switch 18 is opened and at the same time, the the half-latch detecting switch 36 of the door closing device control device D1 is closed.

When the door-close detecting switch 18 is opened, the relays R6 and R8 are deenergized at the same time. Due to deenergization of the relay R6, the contact R6-1 is opened and the other contact R6-2 is closed. Thus, the reversed rotation of the motor 16 is ceased, and thus the door moving operation of the door moving device A is ceased.

Due to deenergization of the relay R8, the contact R8-1 is closed and thus electric power is fed toward the timer control device G through the contact R8-1. At this time, the timer T and the relay R0 are kept in their self-holding conditions. Thus, the electric power feeding toward the timer control device G has no effect on them.

When the operation of the door moving device A is ceased, the half-latch detecting switch 36 of the door closing device control device D1 is closed as has been mentioned hereinabove. With this, the relay R3 is energized and kept in the self-holding condition.

With this, the contact R3-1 is closed, the contact R3-2 is opened, and the circuit including the contact R3-1, the motor 29 and the contact R2-2 is established, so that the motor 29 is energized to run in a normal direction.

When, due to normal rotation of the motor 29, the sector gear 32 is pivoted in a counterclockwise direction in FIG. 1, the cable 33 is pulled leftward turning the close lever 34. With this, the latch pawl of the door lock device 27 is forced to achieve a complete engagement with the striker enforcedly shifting the door 12 to the full-close latched position. It is to be noted that this shifting of the door 12 is achieved by only the door closing device D.

When the sector gear 32 is pivoted in a counterclockwise direction in FIG. 1 from the rest position, the return recognition switch 38 is closed or turned ON. However, this closing of the switch 38 has no effect on the relays.

When, thereafter, the latch pawl of the door lock device 27 is turned to the full-latch position, the full-latch detecting switch 37 is closed causing deenergization of the relay R3 and energization of the relay R2.

With this, the contacts R3-1 and R2-2 are opened and the contacts R2-1 and R3-2 are closed, so that the circuit including the contact R2-1, the motor 29 and the contact R3-2 is established thereby energizing the motor 29 to run in a reversed direction.

With this, the sector gear 32 is pivoted in a clockwise direction to the rest position as shown in FIG. 1.

Upon this, the return recognition switch 38 is opened causing deenergization of the relay R2. Thus, the contact R2-1 is opened and the contact R3-2 is closed, so that the motor 29 is deenergized, and thus the motor 29 stops.

When, thereafter, the predetermined time set by the timer T elapses, the relay R0 is deenergized causing the contact R0-1 to open. With this, electric power feeding toward the electric connector C stops and all parts are returned to the positions which are taken when the door 12 assumes the full-close latched position.

In the following, abnormal operation of the second embodiment will be described, which operation is carried out when something is wrong with the power slide door 12.

When the door 12 is moved in a closing direction to a position between the feeding start position and the half-latch available position and there the door 12 is forced to stop due to, for example, a foreign thing caught between the door 12 and the vehicle body 11, the electric power feeding toward the electric connector C is ceased upon expiration of the time set by the timer T.

In this case, the following steps are taken by an operator.

First, the foreign object is removed and then the door closing control switch 23 of the controlling device B is opened and closed. With this, the relay R6 and the relay R8 are simultaneously energized because the door-closing detecting switch 18 has been still closed.

With the energization of the relay R6, the door moving device A starts to operate in a manner to close the door 12.

With the energization of the relay R8, the contact R8-1 of the relay R8 is opened, so that the electric power feeding to the timer control device G is ceased.

When, due to operation of the door moving device A, the door 12 is moved to the half-latch available position, the door-closing detecting switch 18 opens. Thus, the relays R6 and R8 are simultaneously deenergized.

With the deenergization of the relay R6, the operation of the door moving device A is forced to stop.

With the deenergization of the relay R8, the contact R8-1 of the relay R8 is closed, so that electric power feeding to the timer control device G starts and the relay R0 is energized.

Thus, the timer T starts time counting. With the energization of the relay R0, the contact R0-1 of the relay R0 is closed, so that electric power feeding to the door closing device control device D1 starts.

Since the door 12 has already reached the half-latch available position, the half-latch detecting switch 36 of the door closing device D is kept closed. Accordingly, the electric power feeding to the control device D1 induces instantly the operation of the door closing device D. Thus, the door 12 is shifted to the full-close latched position in a manner as has been described hereinabove.

As will be understood from the above, in the second embodiment of the present invention, the shifting of the slide door 12 from the half-latch position to the full-close latched position is achieved by only the door closing device D. This is the same as that carried out in the afore-mentioned first embodiment.

Furthermore, in the second embodiment, even when the door 12 is forced to stop by, for example, a foreign thing accidentally caught between the door 12 and the vehicle body 11 during closing movement of the door 12, this undesired matter is easily eliminated by taking simple recovery steps as has been described hereinabove.

What is claimed is:

1. An automatic door operating system for use in a motor vehicle having a vehicle body and a movable door, comprising:

first means for allowing said door to assume an open position, a half-latch position and a full-close latched position, said open position being a position wherein said door opens a door opening defined by said vehicle body, said half-latch position being a position wherein said door is halfly latched to the vehicle body while almost closing said door opening and said full-close latched position being a position wherein said door is fully latched to the vehicle body while fully closing the door opening;

an electric door moving device for moving said door between said open position and said full-close latched position when energized;

an electric door closing device for shifting said door from said half-latch position to said full-close latched position when energized; and second means for controlling the door closing operation of said electric door moving device;

third means for feeding said electric door closing device with electric power; and fourth means for allowing said second and third means to cooperate with each other to eliminate a possible trouble which may occur when said door comes to a position adjacent to said half-latch position.

2. An automatic door operating system as claimed in claim 1, in which said second, third and fourth means cooperate with one another to stop energization of said door moving device during the time for which said door closing device is being energized.

3. An automatic door operating system as claimed in claim 2, in which said second means comprises:

a door-close detecting switch which is connected to said door moving device and turned OFF when said door, during closing movement, passes by said half-latch position;

a door-open detecting switch which is connected to said door moving device and turned ON when said door comes to a position to fully open the said door opening; and a door-closing control switch connected in series with said door-close detecting switch, said door-close detecting switch and said door closing control switches being so arranged that when these switches are both closed, said door moving device operates to move said door in the closing direction.

4. An automatic door operating system as claimed in claim 3, in which said third means comprises:

a feeding start position detecting switch which is closed for a moment when said door, during its closing movement, passes by a feeding start position near said half-latch position; and timer means for limiting the period of time for which said door closing device is being energized.

5. An automatic door operating system as claimed in claim 4, in which said fourth means comprises:

a current detector which issues an information signal when said door closing device is energized; and stop control means which breaks the electric connection between said door-close detecting switch and said door closing control switch when said current detector issues said information signal.

6. An automatic door operating system as claimed in claim 5, in which said stop control means comprises:

an AND gate having one input terminal connected to said door closing control switch and an output terminal connected to said door-close detecting switch; and an inverter having one terminal connected to the other input terminal of said AND gate and the other terminal connected to said current detector.

7. An automatic door operating system as claimed in claim 6, in which said first means comprises:

a door guide structure by which said door is slidably movable along a side surface of the vehicle body; and a door lock device for incompletely and completely latching said door relative to said vehicle body.

8. An automatic door operating system as claimed in claim 7, in which each of said door moving device and said door closing device employs an electric motor as a prime mover.

9. An automatic door operating system as claimed in claim 8, in which said door lock device comprises a latch pawl pivotally connected to said door and a striker secured to said vehicle body, said latch pawl being latchingly engageable with said striker.

10. An automatic door operating system as claimed in claim 1, in which said second, third and fourth means cooperate with one another to make said third means operative again after said third means becomes inoperative due to accidental stop of said door near said half-latch position.

11. An automatic door operating system as claimed in claim 10, in which said second means comprises:

a door-close detecting switch which is connected to said door moving device and turned OFF when said door, during closing movement, passes by said half-latch position;

a door-open detecting switch which is connected to said door moving device and turned ON when said door comes to a position to fully open said door opening; and a door closing control switch connected in series with said door-close detecting switch, said door-close detecting switch and sad door closing control switch being so arranged that when these switches are both closed, said door moving device is operated to move said door in the closing direction.

12. An automatic door operating system as claimed in claim 11, in which said third means comprises:

a feeding start position detecting switch which is closed for a moment when said door, during its closing movement, passes by a feeding start position near said half-latch position; and timer means for limiting the period of time for which said door closing device is being energized.

13. An automatic door operating system as claimed in claim 12, in which said fourth means comprises a relay which is interposed between said door-close detecting switch and said door closing control switch, said relay having a normally closed contact which is arranged in parallel with said feeding start position detecting switch.

14. An automatic door operating system as claimed in claim 13, in which said first means comprises:

a door guide structure by which said door is slidably movable along a side surface of the vehicle body; and a door lock device for incompletely and completely latching said door relative to said vehicle body.

15. An automatic door operating system as claimed in claim 14, in which each of said door moving device and said door closing device employs an electric motor as a prime mover.

16. An automatic door operating system as claimed in claim 15, in which said door lock device comprises a latch pawl pivotally connected to said door and a striker secured to said vehicle body, said latch pawl being latchingly engageable with said striker.

* * * * *